United States Patent [19]

Maddock

[11] Patent Number: 4,734,021

[45] Date of Patent: Mar. 29, 1988

[54] MACHINE FOR BUILDING A DOME OR SPHERE

[76] Inventor: Paul T. Maddock, 35 Waterloo Street, Kitchener, Ontario, Canada, N2H 3T8

[21] Appl. No.: 875,192

[22] Filed: Jun. 17, 1986

[30] Foreign Application Priority Data

May 23, 1986 [CA] Canada ..... 509853

[51] Int. Cl.[4] ..... E04G 21/04

[52] U.S. Cl. ..... 425/60; 264/32; 264/33; 425/64; 425/65; 425/113; 425/224; 425/449

[58] Field of Search ..... 425/60, 4 C, 64, 65, 425/88, 224, 449, 817 C, 113; 264/32, 33, 46.3

[56] References Cited

U.S. PATENT DOCUMENTS

| | | | |
|---|---|---|---|
| 2,339,892 | 1/1944 | Urschel | 425/60 |
| 3,206,899 | 9/1965 | Wright | 425/817 C |
| 3,352,525 | 11/1967 | Lowes | 264/32 |
| 3,443,276 | 5/1969 | Smith et al. | 264/32 |
| 3,888,959 | 6/1975 | Phillips | 264/32 |
| 4,193,750 | 3/1980 | Nielson | 425/60 |

*Primary Examiner*—Jay H. Woo
*Assistant Examiner*—James C. Housel
*Attorney, Agent, or Firm*—Daryl W. Schnurr

[57] ABSTRACT

A machine for building a dome or sphere has an extruder that extrudes part of a wall of a dome or sphere from fluid material which hardens on extrusion as the extruder travels around a center axis. A ramp allows the extruder to gradually ride up onto the initial wall so that another partial wall of the sphere can be formed. The extruder continuously moves along its own produced track in a spiral path to ultimately form a dome or sphere, as desired.

6 Claims, 4 Drawing Figures

MACHINE FOR BUILDING A DOME OR SPHERE

BACKGROUND OF THE INVENTION

1. Field of the Invention

This invention relates to a machine and method for producing a wall of a dome or sphere from fluid type materials.

2. Description of the Prior Art

In the building of a dome or a spherical construction it is often necessary to use rigid structural materials and manpower to produce the shape of the outer wall.

It is the object of the invention to construct the said type of building by using a machine so as to decrease the amount of manual labour and also to use materials that can be supplied in a fluid type form which has the advantage of being easier to transport by use of smaller volume to construction sites in remote locations and that of environmental hazardous areas like outer space.

Also in the painting of a dome or sphere with different color materials such as the painting of large signs or the emblem of a country on its outer surface, additional labour has to be used to brush paint, spray or use rigid colored materials.

It is the object of the invention to use the dome or sphere making machine to be able to produce different colors at the desired location of the wall by injecting different color materials into its fluid material supply and automatically producing the desired pattern on the wall of the dome or sphere.

SUMMARY OF THE INVENTION

A machine for producing independent of the ground an outer wall of a circular structure of generally spherical shape has an extruder connected to a radial arm that is rotatably mounted on a top of a column. The column has a bottom supported by a base affixed to said column with a support assembly located beneath said base. The base has a periphery with a ramped track thereon. The arm and extruder are rotatable about a longitudinal axis of said column. The column is stationary relative to said base and the base contains a sealed passageway interconnecting said support assembly and said column. An interior of said column provides a pathway for electrical power and cable controls and pipes carrying fluid material continuously from said support assembly through said base to a top of said column and through said arm to said extruder. The extruder is capable of extruding a wall from said fluid material which hardens on extrusion as said extruder travels around said longitudinal axis. The extruder initially travels around said ramped track to form a first layer of said wall thereon. The extruder continuously moving along its own produced track in a spiral path to deposit successive layers, with each layer deposited forming a track for said extruder to deposit a subsequent layer, thus forming a wall in the shape of a circular structure. The machine is movable in any direction relative to the ground during formation of the circular structure without interfering with said formation.

BRIEF DESCRIPTION OF THE DRAWINGS

A dome or sphere building machine according to the invention is hereinafter described, by way of example only, with reference to the accompanying drawings, in which.

DESCRIPTION OF A PREFERRED EMBODIMENT

Figure 1:
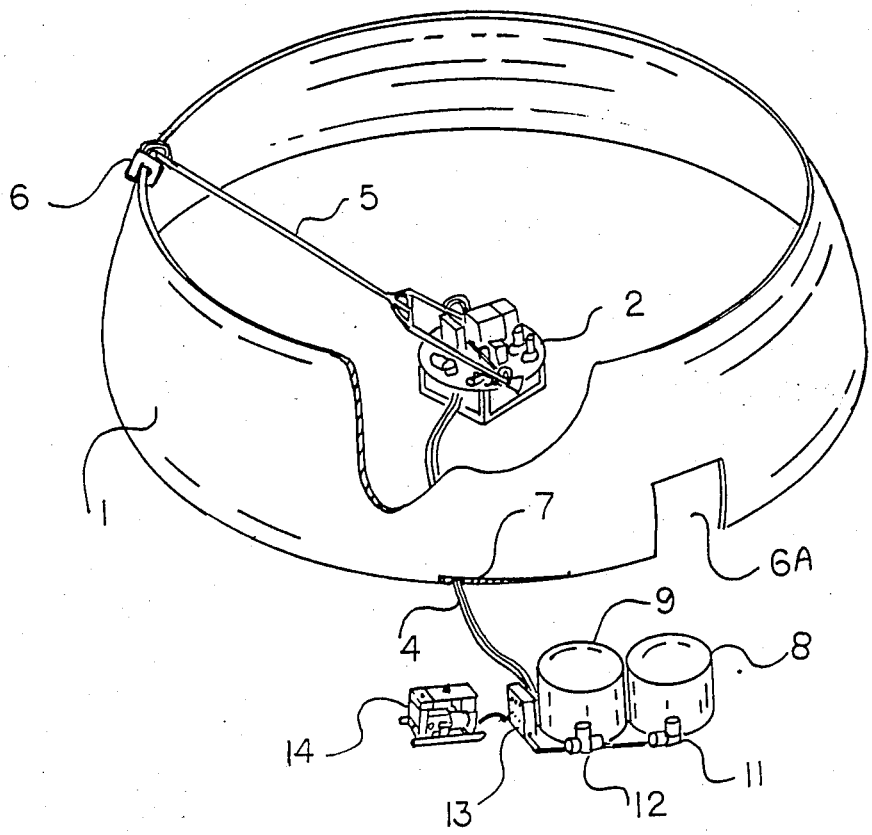
FIG. 1 is a perspective view of a dome building under construction showing a wall building apparatus fed by a rotating material supply machinery bed with external material supply and power equipment.

FIG. 1 shows the dome building 1 being constructed by the wall extruding apparatus 6 (also shown in FIG. 3) which moves in a clockwise direction. The apparatus 6 is fed with material and electrical power via control via arm 5 (this arm can be adjustable in length) from the rotating machinery bed 2. The machinery bed 2 is given power via cable and pipes from outside the dome connected to a generator 14 with control panel 13. Material from tanks 8 and 9 is supplied to the bed 2 using pumps 11 and 12. A ramp 7 is provided so as to enable the wall extruding apparatus to gradually rise and mount the first loop of the wall using it for a track to start the continuous spiral.

Figure 2:
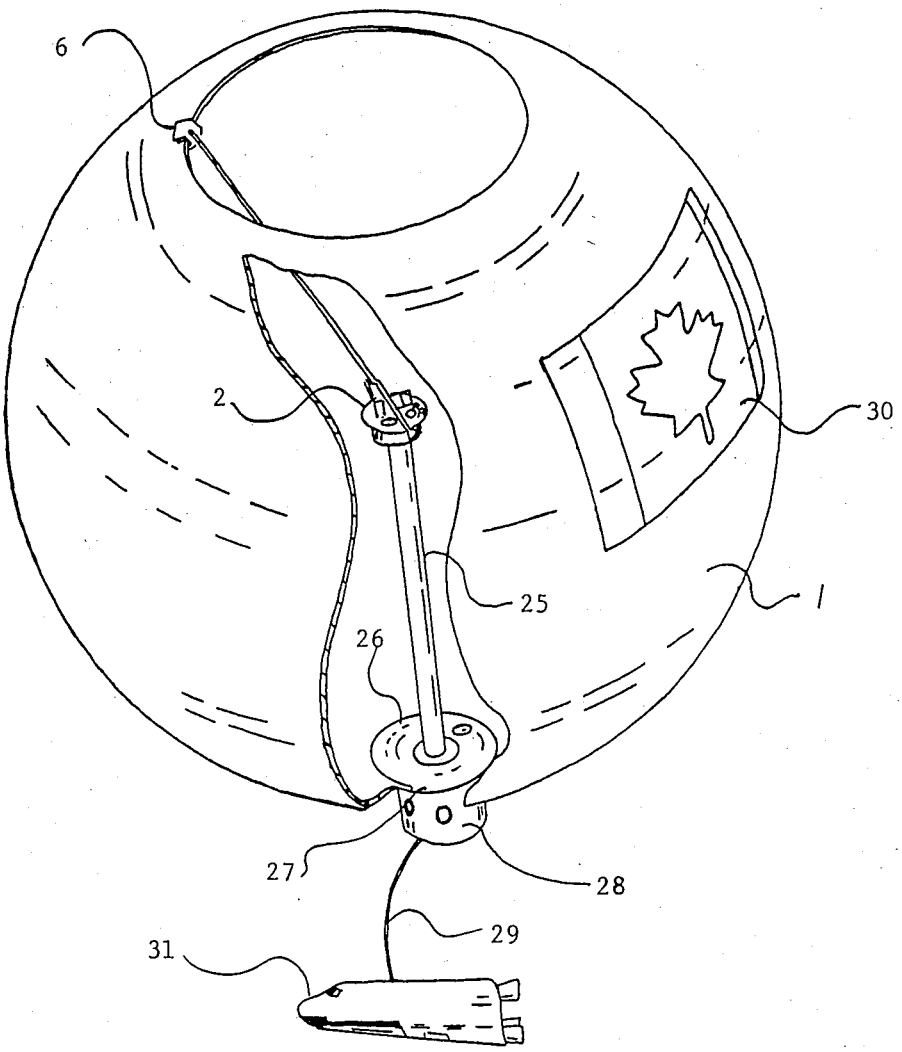
FIG. 2 is a partially cut-away perspective view of a sphere under construction in outer space.

FIG. 2 shows a sphere being constructed in outer space. A station 28 provides living accommodation for astronauts. Column 25 gives internal access to the rotating fluid supply machinery bed 2 and is also used for a pathway for cables and supply pipes for materials to the machinery bed 2. Station 28 also serves as a monitoring and control station for the machinery bed 2 and the wall extruding apparatus 6. The initial pass of wall has a track provided with disc 26, which, in turn, contains a ramp 27. The wall extruding apparatus can mount the ramp 27 during its first pass and use it as a track to proceed with a continuous wall to eventually form the shape of a sphere. A flag 20 or other desirable insignia or symbol can be produced by using colored material at correct intervals and is fed from the machinery bed 2 while controlled from station 28. Additional material can be transported to the station 28 by a space shuttle 31 and is pumped through the attached hoses 29.

Figure 3:
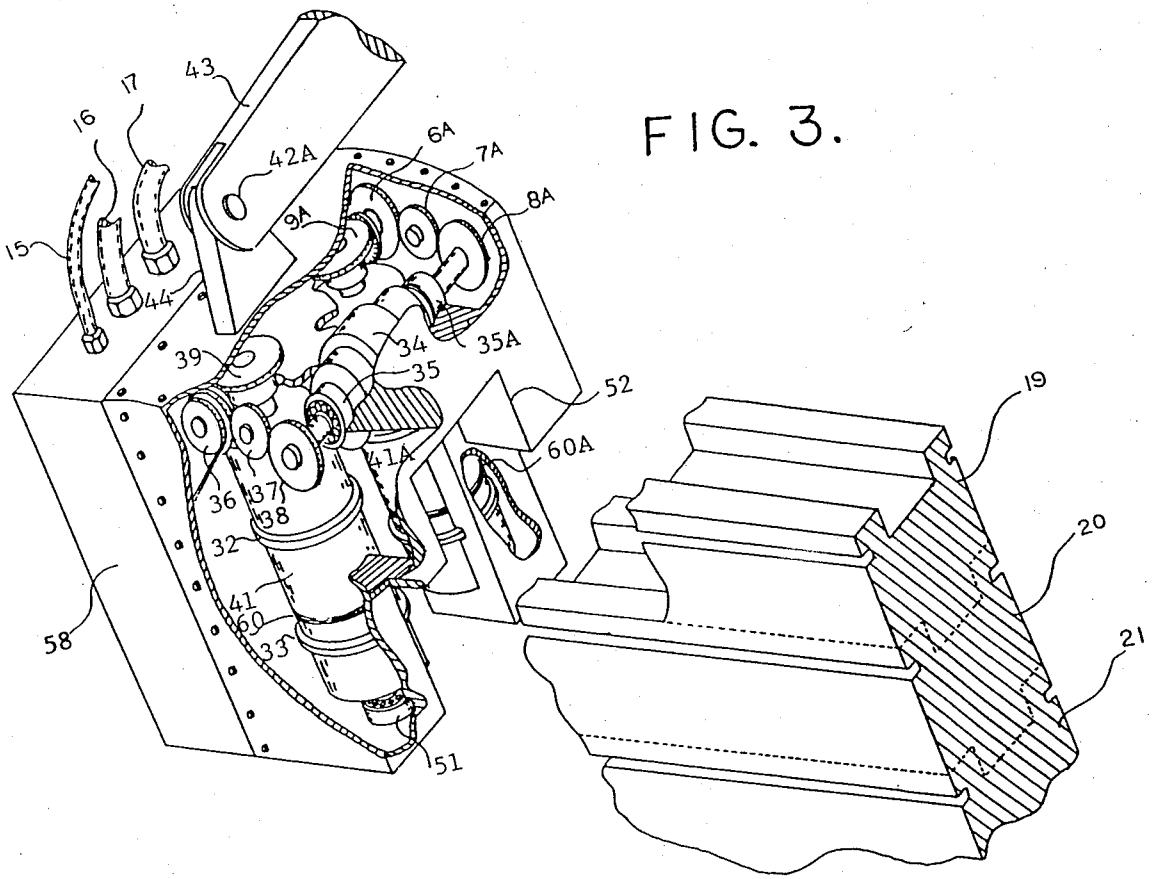
FIG. 3 is a partially cut-away perspective view of the wall producing apparatus and a portion of a wall.

FIG. 3 shows a more detailed drawing of the apparatus for extruding the wall of the dome or sphere. Fluid material is supplied through pipes 16 and 17 to a mixing unit not shown inside casing 18. Electric and control power is supplied through cables in conduit 15 to mixing unit and drive motor which are not shown inside casing 18. The motor drives pulley and gear 36 which drives roller 41 through gear 39. The motor also drives roller 34 with gears 37 and 38 which contain a ring that produces a groove into the side of extruded wall 19. The roller 34 is supported by bearings 35 and 35A. Roller 34 also drives roller 41A with gear train 38A, 37A, 36A and 39A. The bottom half of rollers 41 and 41A is divided by flexible joints 50 and 50A which allows the rollers 41 and 41A to move along slight curves in the wall. The rollers 41 show rings 32 and 33. The top ring 32 is used for shaping the groove into the extruded wall 19. the bottom ring 33 is used for locating a track into the grooves of the already hardened previously extruded wall 20. The wall preceding the pass represented by 50 is represented by 21. The top half of roller 41 has a centre shaft which runs down to bottom bearing 51 while the bottom half of the roller 41 is held by flexible joint 60. The casing of this apparatus is represented by 52 and 58. The casing 52, 58 is supported by support 44 and is coupled to be allowed movement to arm 43 with pin 42A. Arm 43 is joined to the end of arm 45 shown in FIG. 4.

Figure 4:
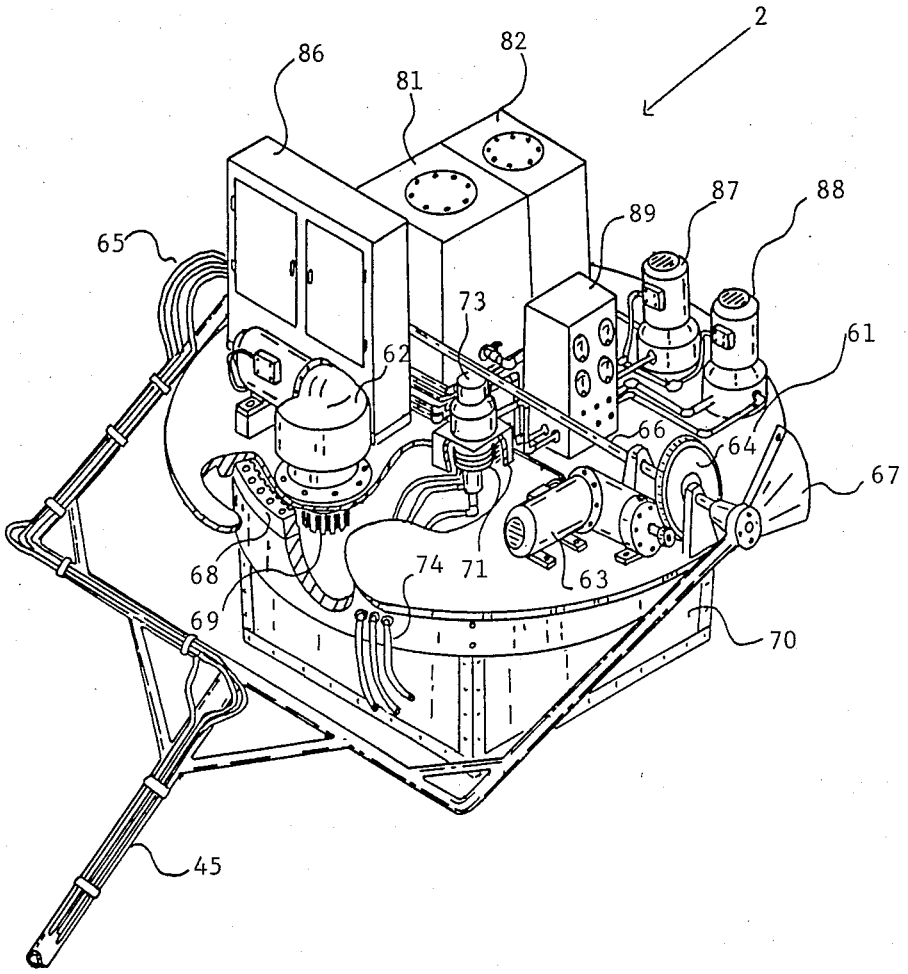
FIG. 4 is a partially cut-away perspective view of the rotating fluid material supply machinery bed.

FIG. 4 shows the rotating machinery bed 2. The machinery bed floor 61 is rotated around slewing ring 68 (which has roller bearings and gears) by pinion gear 69 which is driven by slewing motor and reduction drive 62. Arm 45 which is connected to the apparatus for extruding the wall is supported by shaft 66 and is raised and lowered luffing motor and reduction drive 63 that drives gear 64 that is on shaft 66. The arm 45 has a counterbalance weight 67 and the arm is also used to carry electrical power and control cables and material supply pipes 65 to the apparatus for extruding the wall (not shown). Material and power (electrical) is supplied to the machinery bed 2 by cables and pipes 74 through rotating joints 73 and slip rings 71. Material is stored in reservoir tanks 81 and 82 and is pumped to the wall extruding apparatus with dosage pumps 87 and 88. The rate of material pumped by the dosage pumps is controlled by electrical panel 86 and control regulating manifold panel 89. Slewing ring 68 is supported by base 70.

In operation, the machine rotates at a radius to the rotating material supply machinery bed which supplies the apparatus with a continuous flow of fluid materials, for example, two component plastic or cements by use of an adjustable connecting arm.

After the first loop of wall is formed the materials which are fast setting will be strong enough to support the apparatus and form a track to support the said apparatus by using a supplied ramp to gradually raise the movement of the apparatus so as to mount the initial first pass thus producing a second layer of wall and to keep the apparatus in a continuous spiral path.

To form the shape of a sphere, the first loop is started near the base of the axis of the rotating machinery bed. To form the shape of a dome, the spiral starts when the initial loop is perpendicular to the centre of the machinery bed axis.

For the apparatus used for forming the shape of the wall, three driven rollers are used, two in parallel which are located on either side of the wall and the other across the top so as to roll out the shape and sides and the top of the extruding wall. The rollers on either side of the wall are constructed so that their bottom portions are spring-loaded so as to bend to the curved shape of the wall.

The rollers on either side of the wall also have a ring on their top portion so as to form a groove on either side of the wall which is extruded. The purpose of the rings, in the bottom half of the rollers, is to locate in the groove of the immediately preceding wall to form a track so as to hold a machine in a secure path.

The top roller of the apparatus has a ring for forming a groove along the top of the wall. This groove is used to make a secure bed for the foundation of the extruded wall to be formed on said wall.

The rollers of the apparatus for forming the wall are driven in unison by means of gears and a motor powered by electric or fluid. The movement of the motor is controlled electronically together with the rotation of the material supply machinery bed so as to be synchronized with the flow of material to form a wall with the correct amount of material to prevent an excess or lack of supply of wall forming materials.

This can be done by monitoring electronically the flow rate of materials to the mixing unit and the chamber preceding the rollers so as to have the correct amount of material before the rollers start moving to produce the shape of the wall. The chamber may be kept heated so as to prevent the materials from hardening prematurely. Also, there are means to pump solvent through the equipment so as to release any blockages that occur.

The rotating material supply bed consists of electric or fluid driven motors with reduction drives for rotating the bed by means of a slewing drive and means to lift the arm which holds the apparatus for extruding the wall. This arm is counterbalanced by weights and also used to support material supply pipes and electrical power cables for the said wall extruding apparatus.

The rotating material supply machinery bed also contains reservoir tanks for materials, and control panels and dosage pumps for supplying the correct amount of fluid material to the apparatus for extruding the wall.

The additional material and power supply are supplied through rotating concentric pipes, swivel joints and electric slip rings to the rotating machinery bed.

It is preferred to mount the dosage pumps on the rotating machinery bed because the pressure of the material pumped to the extruding apparatus is at a greater pressure than the material pumped to the reservoir tanks via the rotating seals which are less reliable under the higher pressure.

It is also preferred that the electric control panels for dosage pumps and other machinery bed motors be contained on the rotating bed so as to reduce the number of electric rings required. Electric rings are only required for the main supply power and a remote control by using microprocessing signal control to reduce the number of control wires through the slip rings to the machinery bed.

On a first pass of the machine of the present invention, a track may be provided for the wall extruding apparatus to run on and to provide a smooth operation when riding over the ramp. Alternatively, if a flat surface is available for a foundation surface, the wall extruding apparatus can ride on small wheels on said surface to create a first pass.

What I claim as my invention is:

1. A machine for producing independent of the ground, an outer wall of a circular structure of generally spherical shape said machine comprising an extruder connected to a radial arm that is rotatably mounted on a top of a column, said column having a bottom supported by a base affixed to said column, with a support assembly located beneath said base, said base having a periphery with a ramped track thereon, said arm and extruder being rotatable about a longitudinal axis of said column, said column being stationary relative to said base, said base containing a sealed passageway interconnecting said support assembly and said column, an interior of said column providing a pathway for electrical power and control cables and pipes carrying fluid material continuously from said support assembly through said base to a top of said column and through said arm to said extruder, said extruder being capable of extruding a wall from said fluid material which hardens on extrusion as said extruder travels around said longitudinal axis in a spiral path, said extruder initially travelling around said ramped track to form a first layer of said wall thereon, said extruder continuously moving along its own produced track in a spiral path to deposit successive layers, with each layer deposited forming a track for said extruder to deposit a subsequent layer, thus forming a wall on said base in the shape of a circular structure, said base being movable in any direction relative to the ground during formation of the circular structure, without interfering with said formation.

2. A machine as claimed in claim 1 wherein there is a machinery bed rotatably mounted on the top of said column and said arm extends from said machinery bed, rotating seals being arranged concentrically with slip rings interconnecting said column with said machinery bed to allow said machinery bed to rotate relative to said column, while maintaining said pathway.

3. A machine as claimed in any one of claims 1 or 2 wherein the extruder contains a roller on both sides of the wall, a bottom half of each roller flexibly joined to a top half to allow for curvature, the top half of one or both rollers containing a ring for forming a groove in the extruded wall, the bottom half, of said one or both rollers, having a matching ring to locate in the groove of an immediately preceding wall section to form a track.

4. A machine as claimed in any one of claims 1 or 2 wherein the extruder contains a roller on both sides of the wall, a bottom half of each roller flexibly jointed to a top half to allow for curvature, the top half of one or both rollers containing a ring for forming a groove in the extruded wall, the bottom half, of said one or both rollers, having a matching ring to locate in the groove of an immediately preceding wall section to form a track, with an additional top roller being provided to shape a top of the extruded wall with a ring on said top roller to produce a groove in the extruded wall so as to form a secure bed for the foundation of a new layer of wall.

5. A machine as claimed in any one of claims 1 or 2 wherein the extruder contains a roller on both sides of the wall, a bottom half of each roller flexibly joined to a top half to allow for curvature, the top half of one or both rollers containing a ring for forming a groove in the extruded wall, the bottom half, of said one or both rollers, having a matching ring to locate in the groove of an immediately preceding wall section to form a track, one or more of the rollers being driven by a gear train and motor so as to move the extruder along said track.

6. A machine as claimed in any one of claims 1 or 2 wherein the extruder contains a roller on both sides of the wall, a bottom half of each roller flexibly joined to a top half to allow for curvature, the top half of one or both rollers containing a ring for forming a groove in the extruded wall, the bottom half, of said one or both rollers, having a matching ring to locate in the groove of an immediately preceding wall section to form a track, with an additional top roller being provided to shape a top of the extruded wall, with a ring on said top roller to produce a groove in the extruded wall so as to form a secure bed for the foundation of a new layer of wall, one or more of the rollers being driven by a gear train and motor so as to move the extruder along said track.

* * * * *